US010034082B2

(12) United States Patent
Cai et al.

(10) Patent No.: US 10,034,082 B2
(45) Date of Patent: Jul. 24, 2018

(54) SPEAKER

(71) Applicants: Bin Cai, Shenzhen (CN); Wei Wei, Shenzhen (CN)

(72) Inventors: Bin Cai, Shenzhen (CN); Wei Wei, Shenzhen (CN)

(73) Assignee: AAC TECHNOLOGIES PTE, LTD., Singapore (SG)

( * ) Notice: Subject to any disclaimer, the term of this patent is extended or adjusted under 35 U.S.C. 154(b) by 0 days.

(21) Appl. No.: 15/416,118

(22) Filed: Jan. 26, 2017

(65) Prior Publication Data

US 2018/0124507 A1 May 3, 2018

(30) Foreign Application Priority Data

Oct. 28, 2016 (CN) ..... 2016 2 1192942 U

(51) Int. Cl.
*H04R 25/00* (2006.01)
*H04R 1/28* (2006.01)
*H04R 1/02* (2006.01)

(52) U.S. Cl.
CPC ..... *H04R 1/2888* (2013.01); *H04R 1/025* (2013.01); *H04R 2201/029* (2013.01)

(58) Field of Classification Search
CPC .. G07F 17/3216; G07F 17/32; G07F 17/3209; H04R 1/02; H04R 1/025; H04R 2499/11; H04R 1/023
USPC ..... 381/345, 349, 354, 355, 369, 391, 387; 181/199, 155, 151, 395, 284
See application file for complete search history.

(56) References Cited

U.S. PATENT DOCUMENTS

2009/0245565 A1* 10/2009 Mittleman ..... H04M 1/035 381/365
2010/0254558 A1* 10/2010 Meyer ..... H04R 1/323 381/345
2013/0283915 A1* 10/2013 Booth ..... G01N 29/22 73/584
2013/0288755 A1* 10/2013 Carlson ..... H04M 1/035 455/569.1
2015/0365744 A1* 12/2015 Cai ..... H04R 1/023 381/412
2016/0127824 A1* 5/2016 Jiang ..... H04R 9/02 381/349

FOREIGN PATENT DOCUMENTS

CN 203446023 U * 2/2014

* cited by examiner

*Primary Examiner* — Matthew Eason
*Assistant Examiner* — Julie X Dang
(74) *Attorney, Agent, or Firm* — Na Xu; IPro, PLLC

(57) ABSTRACT

A speaker is disclosed. The speaker includes a housing with an accommodation space, a retaining wall enclosing an accommodation cavity for accommodating sound absorption materials with one end thereof having an opening, a sound filter covering the opening, and a support ring installed around the sound filter. The sound filter is located between the support ring and the retaining wall, or the support ring is clamped between the sound filter and the retaining wall.

6 Claims, 2 Drawing Sheets

SPEAKER

FIELD OF THE PRESENT DISCLOSURE

The present disclosure relates to the field of electro-acoustic transducers, and more particularly to speaker.

DESCRIPTION OF RELATED ART

Usually, an existing speaker filters the noise by setting a sound absorption cavity, in order to improve its acoustic performance. In a relevant technology, the speaker comprises a housing, an accommodation cavity for accommodating the sound absorption materials and a sound filter disposed in the housing. The accommodation cavity is provided with an opening, and the sound filter is fixed on a side wall of the periphery of the opening for covering the opening. Usually, the sound filter and the side wall are engaged by local heating, in order to melt the top of the side wall, and integrate the sound filter and the side wall closely after cooling. However, if this method of encapsulation and fixation by hot melting is used, if the melting point of the housing is too high, it is impossible to encapsulate the sound filter by hot melting. Further, during the encapsulation by hot melting, it is easy to cause the irreversible damage to the sound filter, e.g. the pollution and crush etc, so that the acoustic performance of the speaker is badly affected.

Thereof, it is necessary to disclose and provide an improved speaker to overcome the above-mentioned disadvantages.

BRIEF DESCRIPTION OF THE DRAWING

Many aspects of the exemplary embodiment can be better understood with reference to the following drawing. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
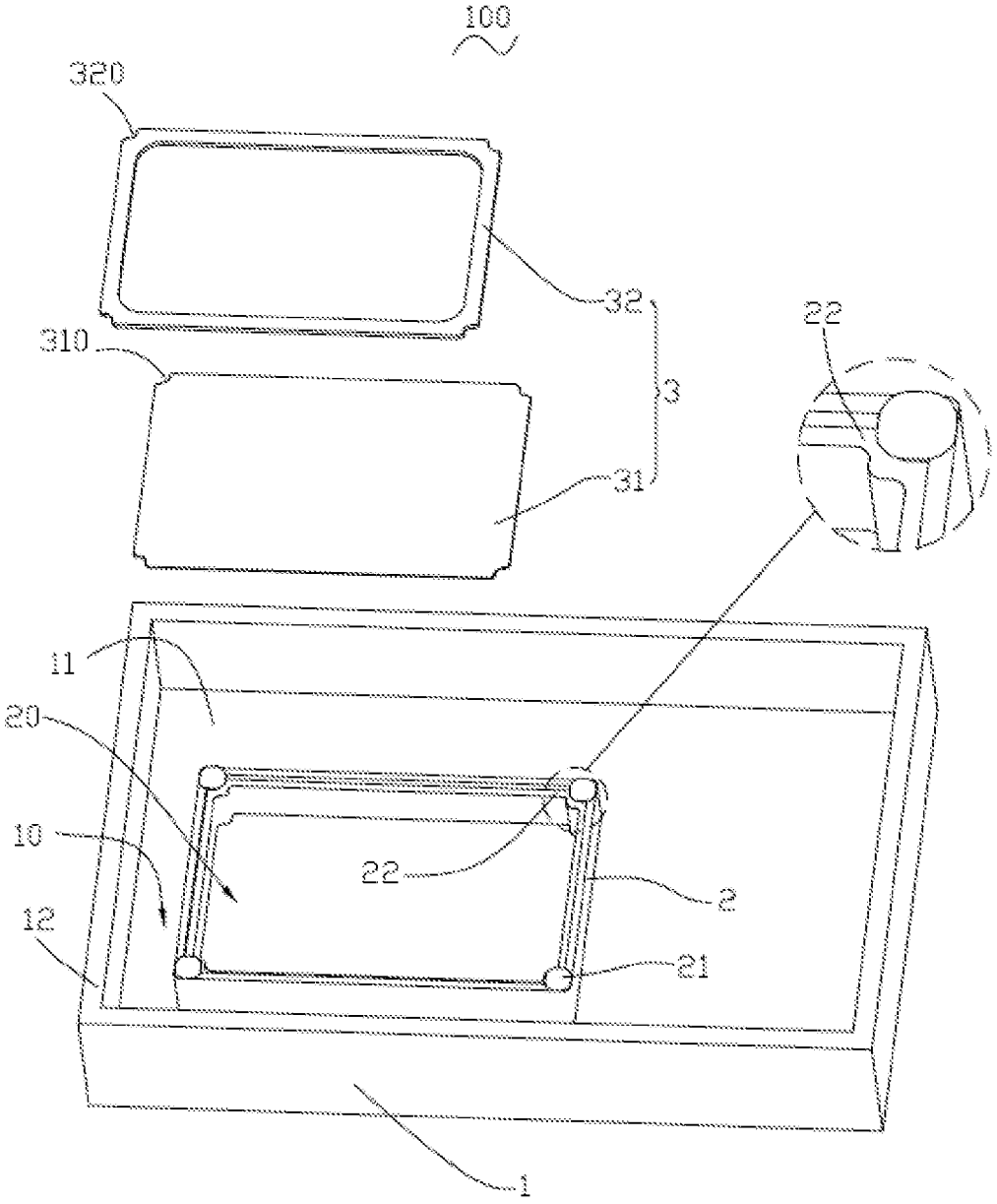
FIG. 1 is an isometric and exploded view of a speaker in accordance with an exemplary embodiment of the present disclosure.
Figure 2:
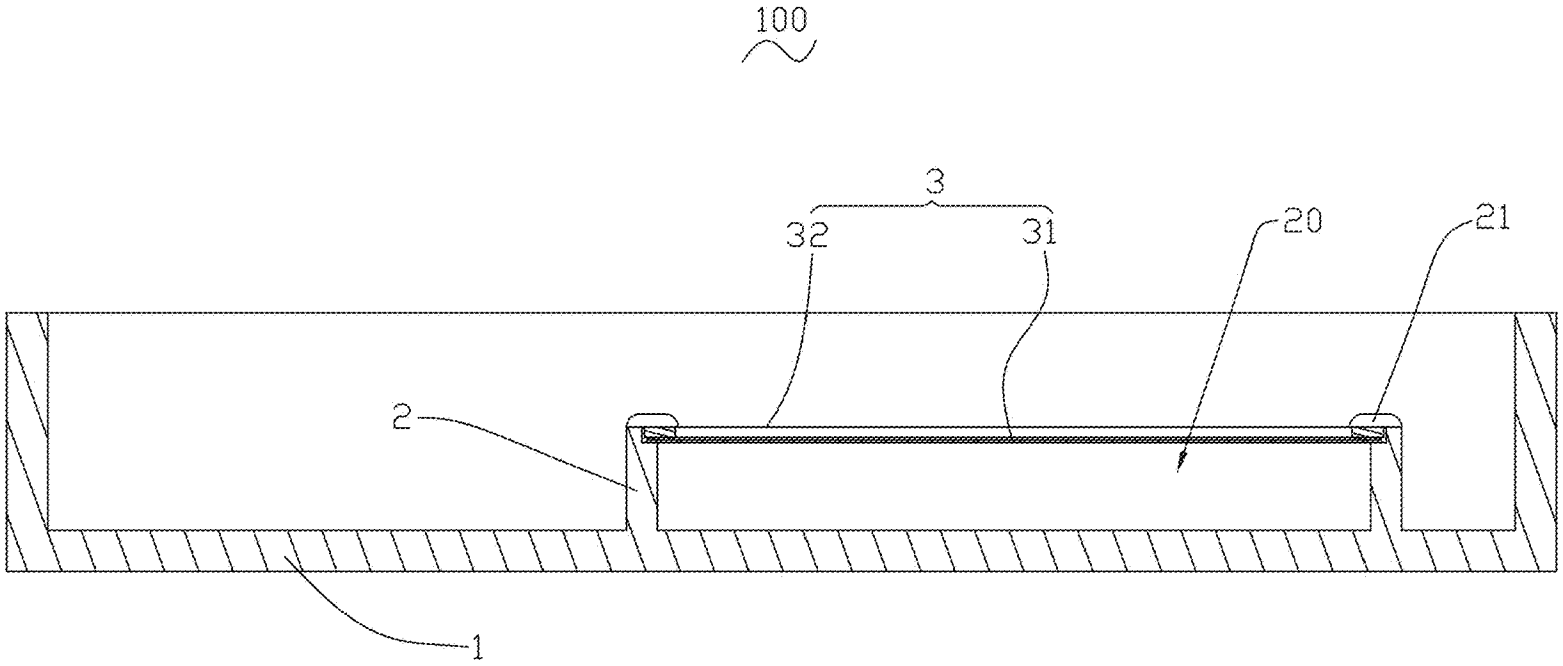
FIG. 2 is a cross-sectional view of the speaker.

Referring to FIGS. 1-2, a speaker 100 comprises a housing 1 with an accommodation space, a retaining wall 2 integrated with the housing 1 which is in the accommodation space, and an insulation structure 3. The housing 1 includes a bottom wall 11 and a side wall 12 bending from the bottom wall 11. The retaining wall 2 extends from the bottom wall 11 and encloses an accommodation cavity 20 used for accommodating sound absorption materials, one end of which forms an opening. The accommodation cavity 20 is enclosed inside the accommodation space. The sound absorption materials are filled in the accommodation cavity 20. The insulation structure 3 covers the whole opening of the retaining wall 2. The accommodation cavity 20 is isolated in the accommodation space by the sound filtering 31, the support ring 32 and the retaining wall 2 with a gap 10 between the side wall 12 and the retaining wall 2.

The insulation structure 3 comprises a sound filter 31 and a support ring 32. The support ring 32 is installed around the sound filter 31 accordingly. In this embodiment, the support ring 32 is pressed and set on the periphery of the sound filter 31, i.e. the sound filter 31 is clamped between the support ring 32 and the retaining wall 2. The sound filter 31 and the support ring 32 are stuck and fixed, and it is fine that the end surface of the retaining wall 2 is fixed to the periphery of the support ring 32. In the other embodiment, the support ring 32 can also be clamped between the sound filter 31 and the retaining wall 2, and the upper end and lower end of the support ring 32 can be fixed to the retaining wall 2 and the sound filter 31 respectively, in order to avoid the damage to the sound filter 31 by direct fixation of the sound filter 31 and the retaining wall 2. As shown in FIG. 1, the retaining wall 2 and the housing 1 are integrated. Understandably, the retaining wall 2 can form an accommodation cavity for accommodating the sound absorption material independently, and then it is inserted into the housing 1. The sound filter 31 can be made of non-woven fabrics, nylon woven net, wool woven net, metal net or paper etc. The support ring 31 can be made of metal ring and plastic ring etc.

Multiple hot melting columns 21 and step parts 22 are set at the end of the retaining wall 2. Specifically, the retaining wall 2 comprises an inside towards the accommodation cavity 20, and an outside opposite to the inside. The upper surface of the retaining wall is connected to the inside and the outside. The hot melting column 21 is set on the upper surface. The step part 22 is formed at the joint between the inside and the upper surface. In this embodiment, the accommodation cavity 20 enclosed by the retaining wall 2 is rectangular, and four hot melting columns 21 are located at four corners of the accommodation cavity 20 respectively.

The periphery of the sound filter 31 is clamped between the step part 22 and the support ring 32. The support ring 32 is heated, melted and fixed to the retaining wall 2 by hot melting column 21. The sound filter 31 and the periphery of the support ring 32 are bridged and connected to the step part 22, in order to make the dustproof structure 3 and the retaining wall 2 form an effective seal structure. The support ring 32 is away from the surface at the bottom of the accommodation cavity 20, which is at the same level on the upper surface. Preferably, the internal diameter of the support ring 32 is less than the size of the opening, and its external diameter is more than the size of the opening. The size of the sound filter 31 is consistent with the size of the external diameter of the support ring 32.

Further, each of the sound filter 31 and the support ring 32 is set with an opening part which avoids the hot melting column 21. In this embodiment, both the sound filter 31 and the support ring 32 are rectangular, and the opening parts are located at four angles of the sound filter 31 and the support ring 32. The opening part includes a first opening part 310 formed at a corner of the sound filtering 31, and a second opening part 320 corresponding to the first opening part 310 and accordingly formed on the support ring 32, for avoiding the hot melting column 21.

Further, the sound filter 31 and the support ring 32 are struck and fixed by glue.

A speaker 100 provided by this utility model has the helpful results as follows:

The dustproof structure 3 comprises a sound filter 31 and a support ring 32 stuck and fixed to the sound filter 31, and the support ring 32 encapsulates the sound filter 31 indirectly, in order to avoid the problem where the sound filter can't be encapsulated directly by hot melting due to too high melting point;

Further, firstly the sound filter 31 is stuck and fixed to the support ring 32, and then the support ring 32 is fixed to the retaining wall 2 by hot melting column 21, in order to avoid the direct hot melting or gluing on the retaining wall 2, and reduce the pollution and damage to the sound filter 31, and protect the performance of the sound filter 31 from being damaged, and guarantee the acoustic performance of the speaker;

There is also a step part 22 set in the end of the retaining wall 2, and the sound filter 31 and the periphery of the support ring 32 are clamped and connected to the step part 22, and the support ring 32 can be pressed only by local hot point, in order to form the effective seal, which is convenient for processing.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker, comprising: a housing with an accommodation space, including a bottom wall and a side wall bending from the bottom wall for enclosing the accommodation space: a retaining wall extending from the bottom wall and enclosing an accommodation cavity for accommodating sound absorption materials, with one end thereof having an opening, wherein the accommodation cavity is enclosed inside the accommodation space, with a gap between the side wall and the retaining wall: a sound filter covering the opening; a support ring installed around the sound filter; wherein the sound filter is located between the support ring and the retaining wall, or the support ring is clamped between the sound filter and the retaining wall and the accommodation cavity is isolated in the accommodation space by the sound filtering, the support ring and the retaining wall; wherein an end surface of the retaining wall is concaved for forming a step part, and the sound filter and the support ring are installed on the step part, and a periphery of the sound filter is clamped between the step part and the support ring, the end surface of the retaining wall is provided with a hot melting column, and the support ring is fixed to the retaining wall after being heated and melted by the hot melting column.

2. The speaker as described in claim 1, wherein the support ring and the sound filter are fixed by glue, and the support ring is a metal ring or plastic ring.

3. The speaker as described in claim 1, wherein the retaining wall comprises an inside towards the accommodation cavity, and an outside opposite to the inside, and an upper surface connecting the inside to the outside, the step part is formed at a joint between the inside and the upper surface.

4. The speaker as described in claim 3, wherein a surface of the support ring away from a bottom of the accommodation cavity is coplanar with the upper surface.

5. The speaker as described in claim 1, wherein the support ring has an internal diameter less than the size of the opening, and an external diameter larger than the size of the opening.

6. The speaker as described in claim 1, wherein a first opening part is formed at a corner of the sound filtering, and corresponding to the first opening part, a second opening part is accordingly formed on the support ring, for avoiding the hot melting column.

* * * * *